US011369187B2

(12) United States Patent
Postolek

(10) Patent No.: US 11,369,187 B2
(45) Date of Patent: Jun. 28, 2022

(54) LOAD RAIL FOR A BACKPACK

(71) Applicant: Filip Postolek, Signal Hill, CA (US)

(72) Inventor: Filip Postolek, Signal Hill, CA (US)

( * ) Notice: Subject to any disclaimer, the term of this patent is extended or adjusted under 35 U.S.C. 154(b) by 182 days.

(21) Appl. No.: 16/749,256

(22) Filed: Jan. 22, 2020

(65) Prior Publication Data

US 2020/0229581 A1 Jul. 23, 2020

Related U.S. Application Data

(60) Provisional application No. 62/795,060, filed on Jan. 22, 2019.

(51) Int. Cl.

| | |
|---|---|
| ***A45F 5/02*** | (2006.01) |
| ***A45C 13/00*** | (2006.01) |
| ***A45F 3/04*** | (2006.01) |
| *A45C 13/30* | (2006.01) |

(52) U.S. Cl.

CPC ..... *A45F 5/02* (2013.01); *A45F 3/04* (2013.01); *A45C 13/001* (2013.01); *A45C 2013/306* (2013.01)

(58) Field of Classification Search

CPC . A45F 5/02; A45F 3/04; A45C 13/001; A45C 2013/306

See application file for complete search history.

(56) References Cited

U.S. PATENT DOCUMENTS

| | | | | |
|---|---|---|---|---|
| 4,860,936 A | | 8/1989 | Lowe | |
| 5,004,135 A | | 4/1991 | Dufournet et al. | |
| 5,297,708 A | * | 3/1994 | Carpenter | A45F 4/02 224/155 |
| 5,419,473 A | * | 5/1995 | Lamar | A63B 55/53 224/632 |
| 5,449,102 A | * | 9/1995 | Sason | A45F 3/047 224/632 |
| 5,553,759 A | * | 9/1996 | McMaster | A45F 3/08 224/259 |
| 5,573,155 A | * | 11/1996 | Sadler | A45F 4/02 224/155 |
| 5,806,740 A | * | 9/1998 | Carlson | A45F 3/047 224/259 |

(Continued)

FOREIGN PATENT DOCUMENTS

| | | |
|---|---|---|
| CN | 206197351 | 5/2017 |
| DE | 2655151 | 6/1978 |
| EP | 0611532 | 4/1998 |

*Primary Examiner* — Brian D Nash

(74) *Attorney, Agent, or Firm* — Dickinson Wright PLLC; Andrew D. Dorisio

(57) ABSTRACT

An apparatus for securing items to a pack for ready and convenient access is provided. The apparatus includes a load rail for use in connection with a pack, such as a backpack. The load rail comprises an elongated body formed of a dimensionally stable material having first and second end portions. The end portions may take the form of depending feet for attaching to the pack via fasteners. A plurality of load rails may be provided along one side of the pack, such as opposite the side including one or more straps for being worn by a user, and may associate with a connector for connecting gear to the pack via the load rails. When mounted, an intermediate portion of the or each load rail may be raised above and spaced from a surface of the pack to facilitate receipt of a portion of the connector.

21 Claims, 4 Drawing Sheets

(56) References Cited

U.S. PATENT DOCUMENTS 5,815,843 A * 10/1998 Brillhart, III ..... A45F 5/02 2/247
5,868,292 A * 2/1999 Stephens ..... A47D 13/025 224/161
6,179,188 B1 1/2001 Gleason
6,857,820 B2 * 2/2005 Jacoway ..... B63C 11/02 224/627
7,437,796 B2 * 10/2008 Rappin ..... A01B 1/065 15/326
7,735,701 B2 6/2010 Eberle
8,690,035 B2 * 4/2014 Silverman ..... A45F 5/00 224/628
8,757,463 B2 * 6/2014 Sagan ..... A45F 3/04 224/644
9,545,144 B2 * 1/2017 Gill ..... A45F 3/04
9,756,920 B2 9/2017 Spears
9,867,450 B2 1/2018 Kotter
10,357,097 B1 7/2019 Goldberg
10,920,928 B2 * 2/2021 Lennings ..... F16M 13/04
2003/0000974 A1 * 1/2003 McUmber ..... A45F 4/02 224/155
2004/0065708 A1 4/2004 Amram
2009/0307878 A1 * 12/2009 Kadas ..... A45F 5/02 24/303
2012/0111904 A1 * 5/2012 Kim ..... A45F 3/14 224/158
2013/0213445 A1 8/2013 Christie
2014/0209646 A1 * 7/2014 Hoppa ..... A45F 3/08 224/261
2015/0041512 A1 * 2/2015 Rief ..... H01M 50/256 224/633
2016/0033235 A1 2/2016 Kinnings
2016/0128454 A1 * 5/2016 Han ..... A45F 5/00 224/153
2018/0014626 A1 * 1/2018 Tang ..... A45C 13/30
2018/0035769 A1 * 2/2018 Wilber ..... A45C 3/00
2019/0038005 A1 2/2019 Bryce
2019/0223579 A1 * 7/2019 Postolek ..... A45F 3/04
2020/0205532 A1 * 7/2020 Streng ..... A45C 13/04
2021/0274920 A1 * 9/2021 Slattery ..... A45C 11/20

* cited by examiner

LOAD RAIL FOR A BACKPACK

This application claims the benefit of U.S. Provisional Patent Application Ser. No. 62/795,060, filed Jan. 22, 2019, the disclosure of which is incorporated herein by reference.

TECHNICAL FIELD

This document relates generally to apparatus for facilitating the carrying of loads and, more particularly, to a rail for connecting a load to a pack, such as a backpack.

BACKGROUND

Hikers and other outdoor adventurers require ready access to trekking and survival gear. Often, backpacks are equipped with external pouches and pockets for this purpose. These pockets can be inconvenient to access, and may require the user to completely remove the backpack in order to retrieve the gear.

Accordingly, it would be desirable to provide an apparatus for readily and reliably attaching gear to a pack, such as to a rear side of a backpack including a pair of straps. The apparatus would allow users to quickly and efficiently retrieve gear connected to the pack without the need for opening it or reaching into a pocket, and would be adapted for a variety of uses.

SUMMARY

According to one aspect of the disclosure, an apparatus for securing items to a pack adapted for being carried by a user is provided. The apparatus includes a load rail including a plurality of openings, and fasteners for removably securing the load rail to the pack. The load rail may comprise an elongated, dimensionally stable structure.

In some embodiments, the plurality of openings include openings extending along an elongated body of the load rail. In some embodiments, the plurality of openings are located at opposed end portions of the elongated body of the load rail for receiving the fasteners. In some embodiments, the load rail includes at least one D-ring forming one of the plurality of openings. One or more of the plurality of openings may comprise a slot.

In some embodiments, the load rail comprises depending feet. End portions of the load rail, such as for example the depending feet, may extend at an angle relative to a longitudinal axis of the elongated body of the load rail. The load rail may be generally C-shaped in profile, such that a portion intermediate the end portions is spaced from an adjacent surface of the backpack or other pack to which it is attached in use.

Still a further aspect of the disclosure pertains to an apparatus adapted for being carried by a user. The apparatus comprises a pack including a first side including a strap and a second side including one or more load rails. The apparatus may further include a plurality of load rails, and connector extending between the plurality of load rails.

In some embodiments, the one or more load rails may be removably attached to the pack, such as by fasteners. At least one of the load rails may include a plurality of openings for receiving fasteners for fastening to the pack. The at least one load rail may also include a central portion elevated above and spaced from an adjacent surface of the pack.

A further aspect of the disclosure pertains to an apparatus adapted for being carried by a user. The apparatus comprises a pack including a first side including a strap and a second side including at least one load rail, wherein the at least one load rail comprises an elongated body having first and seconds ends extending at an angle relative to a longitudinal axis of the body of the at least one load rail.

In some embodiments, the elongated body may comprise a plurality of openings for receiving fasteners for fastening the at least one load rail to the pack. The pack may comprise holes for receiving the fasteners. The at least one load rail may further include at least one D-ring, and the pack may further include at least one strap. When mounted to the pack, a portion of the at least one load rail may be elevated from an adjacent surface of the pack.

BRIEF DESCRIPTION OF THE DRAWING FIGURES

The accompanying drawing figures incorporated herein and forming a part of the specification, illustrate several aspects of the disclosed embodiments and, together with the description, serve to explain certain principles thereof. In the drawing figures.

Reference will now be made in detail to the present preferred embodiments of a load rail for a pack, examples of which are illustrated in the accompanying drawing figures.

DETAILED DESCRIPTION

Figure 1:
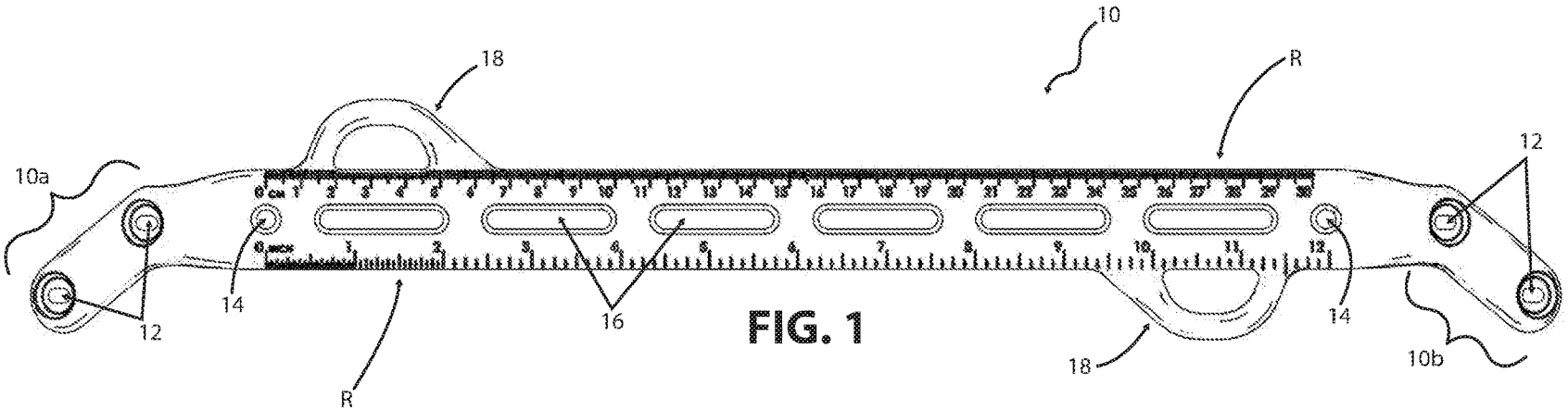
FIG. 1 is a top view of a load rail for interfacing with a backpack.
Figure 2:
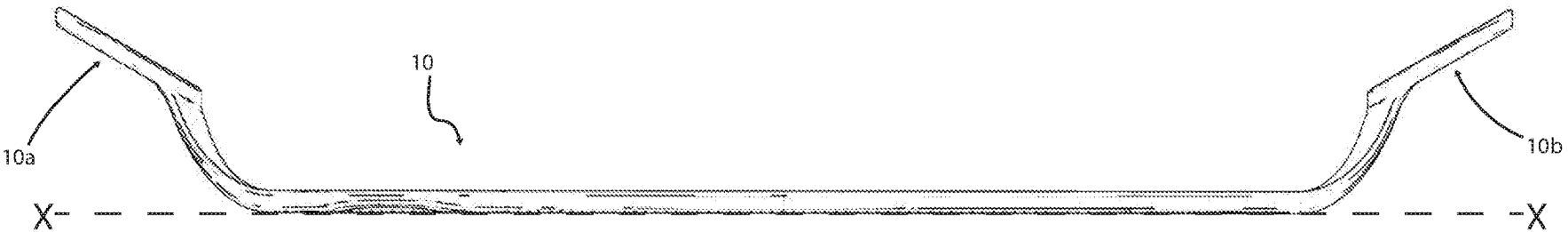
FIG. 2 is a side view of the load rail of FIG. 1.
Figure 3:
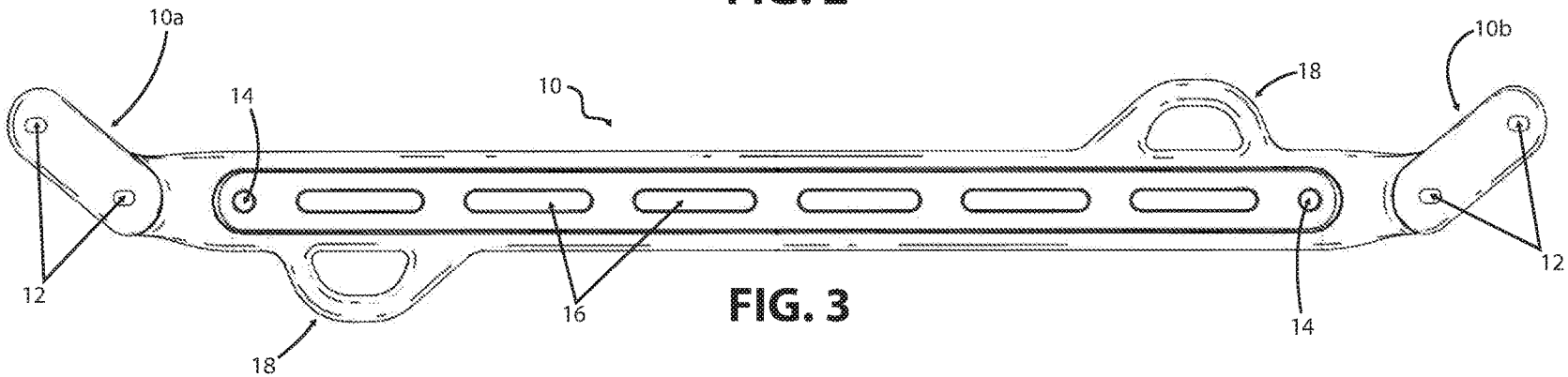
FIG. 3 is a bottom view of the load rail of FIG. 1.

With reference now to FIGS. 1, 2, and 3, an apparatus in the form of a rail 10 for connecting a load, such as one or more objects, to a pack, such as a backpack 30, is disclosed. Being a rail 10, the apparatus thus comprises an elongated body (hence, the term "rail") having first and second end portions. In the illustrated embodiment, the end portions comprise feet 10*a*, 10*b* for attaching to the backpack 30 and supporting the load rail 10. As can be appreciated by comparing FIGS. 1 and 2, the feet 10*a*, 10*b* may extend at an angle relative to a longitudinal axis X of the load rail 10, and also depend from it. In the illustrated embodiment, it can be understood that the load rail 10 has a generally C-shaped profile when viewed from the side, as can perhaps best be understood from FIG. 2.

The load rail 10 may further comprise a plurality of openings. For example, the first and second end portions, or feet 10*a*, 10*b*, may include apertures 12 for receiving one or more fasteners. The fasteners may comprise, for example, mounting screws 20 for connecting the load rail 10 to the backpack 30. The apertures 12 may be recessed within the body, such that the mounting screws 20 in the mounted condition do not appreciably project above an upper surface of the body of the load rail 10.

The plurality of openings may also comprise openings 14 in the body, as well as one or more slots 16 for fixedly attaching equipment to the load rail 10. The load rail 10 may include one or more peripheral extensions 18 generally in the form of a D-shape, which also form openings. However, these extensions 18 may take other shapes or forms without limitation.

Figure 5:
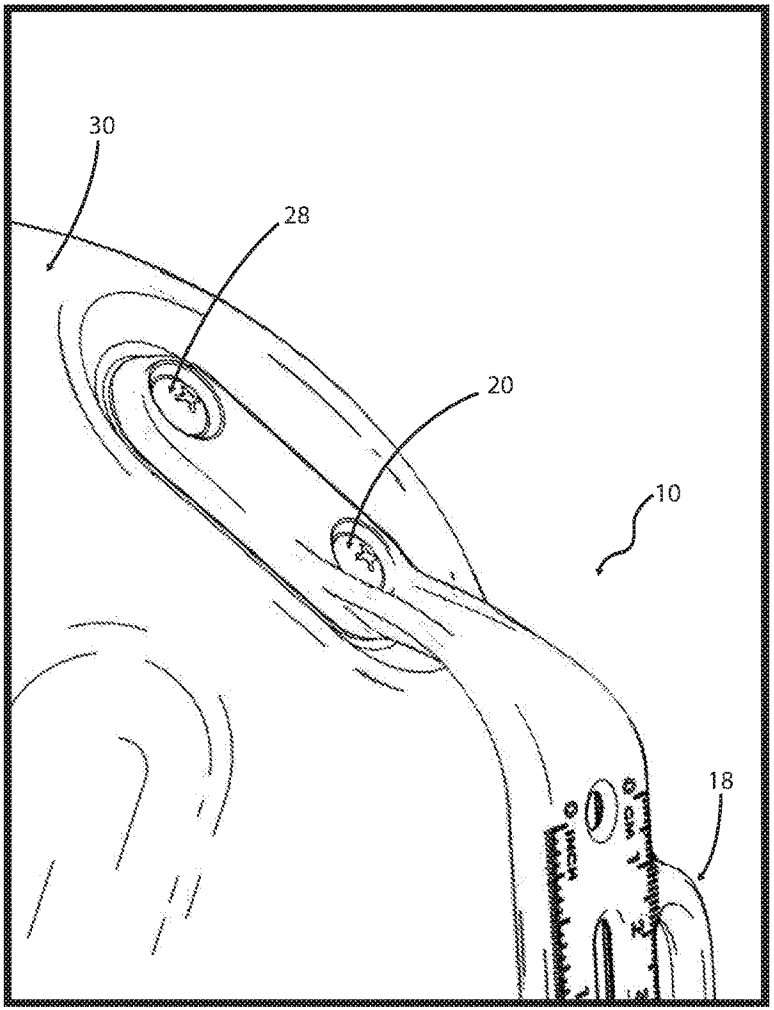
FIGS. 4 and 5 illustrate the mounting locations of the load rail of FIG. 1.
Figure 4:
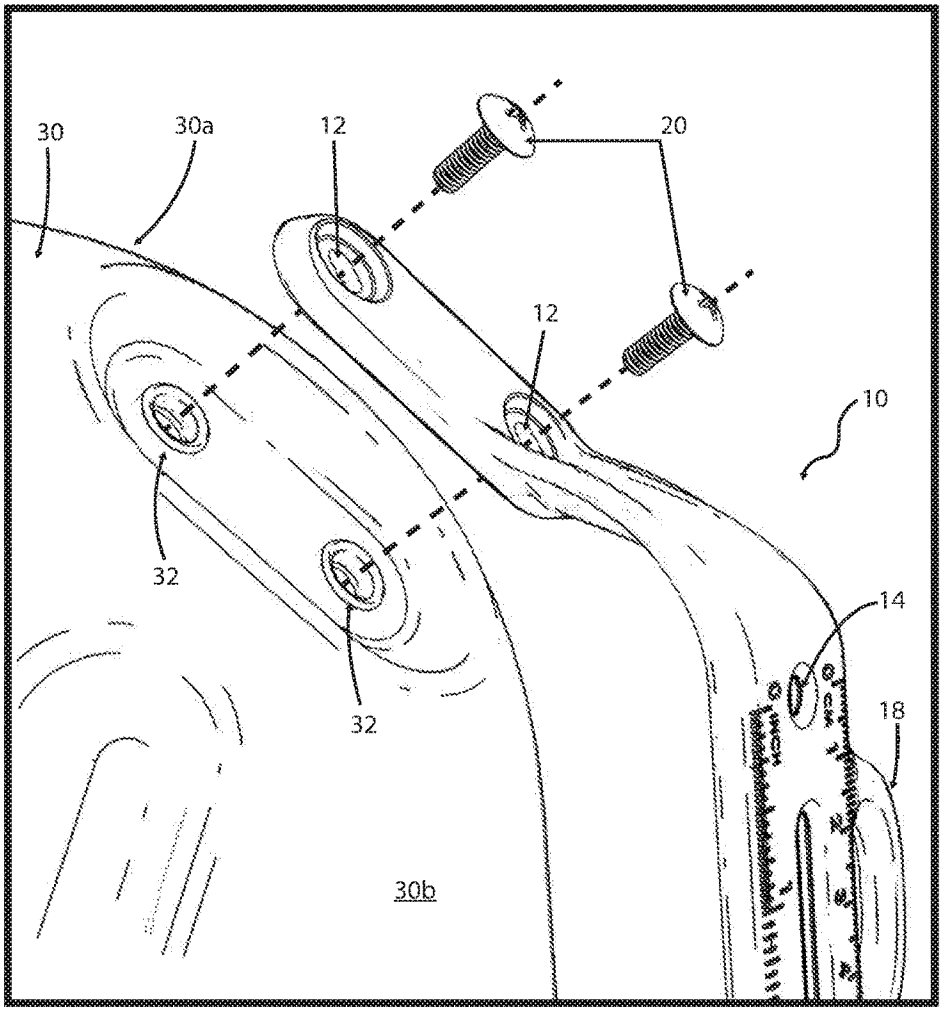

As demonstrated in FIG. 4, the backpack 30 may include mounts, such as holes 32, which may be located in a recessed portion 30*a* formed on a rigid or semi-rigid panel 30*b* of the backpack. In the mounted position, the apertures 12 of the first and second end portions of the load rail 10 align with the respective mounting holes 32 of the backpack 30. Fasteners, such as mounting screws 20, may then pass through the apertures 12 and be secured in the mounting holes 32, which may be internally threaded. Once the mounting screws 20 are tightened, the ends of the load rail 10 lie flush with the backpack 30, as can be seen in FIG. 5, but the intermediate or central portion of the rail (that is, the part between the feet) is elevated relative to a corresponding surface of the backpack 30 (see FIG. 7 and note space S), such that the two are spaced apart from each other.

Figure 6:
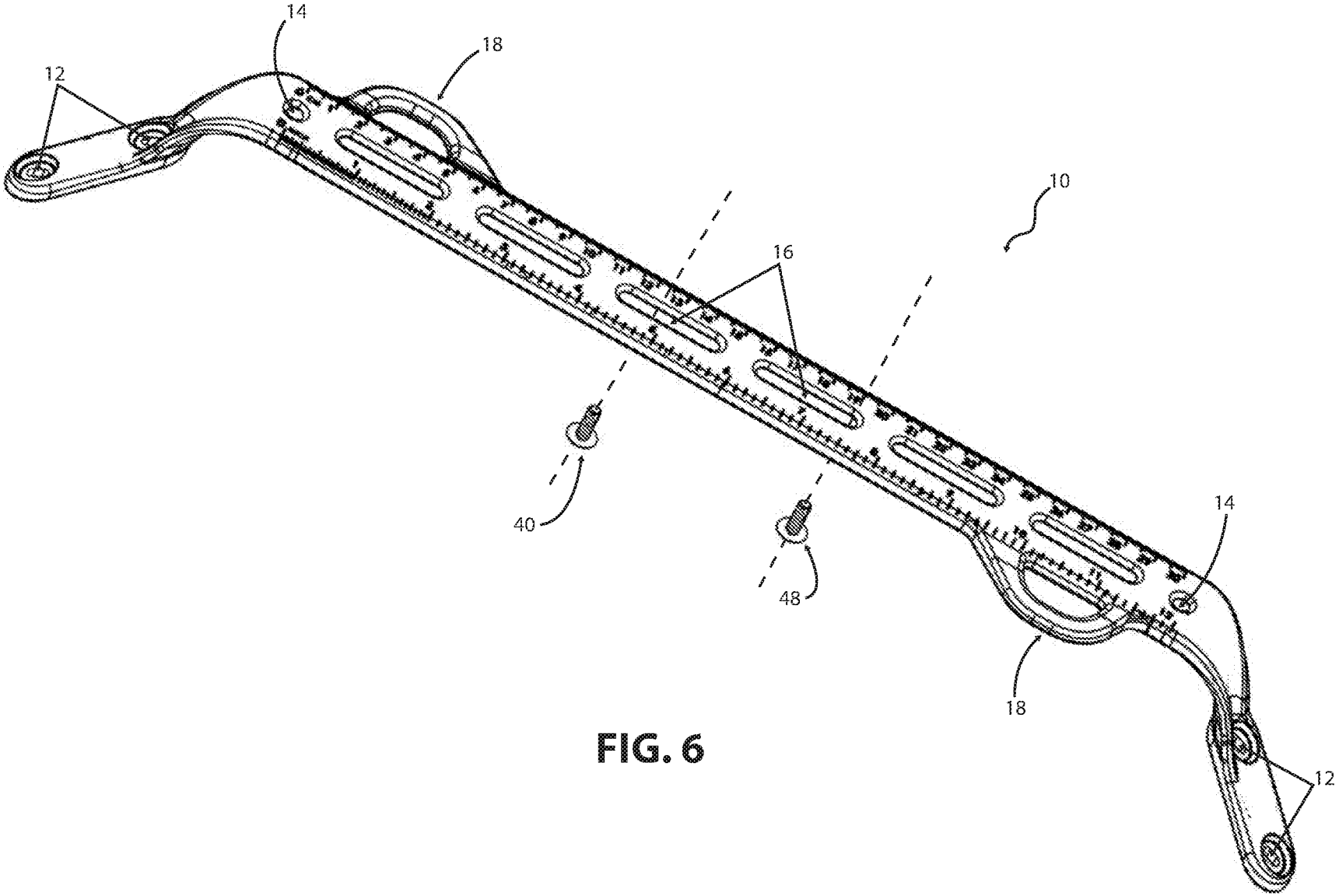
FIG. 6 is a perspective view illustrating additional mounting devices to be used in correspondence with the load rail of FIG. 1.

Once the load rail 10 is securely attached to the backpack 30, a variety of gear and other equipment may be attached to the rail 10. As demonstrated in FIG. 6, fasteners, such as bolts 40, may be inserted through slots 16 to engage and secure equipment to the rail 10. Such equipment may include, but is not limited to, knife sheaths, magazine pouches, flashlight holsters, and other common outdoor gear. Equipment may be fixedly attached to the load rail 10 by fully tightening the fasteners 40 onto the rail 10. Alternatively, the fasteners 40 may simply be loosened to allow for movement within the slot 16, which advantageously allow for a variety of mounting positions to be achieved. It should also be appreciated that the fasteners 40 may be used to secure gear in the openings 14. Additional equipment may be secured to the body of the rail 10 without the use of the fasteners 40, such as by clipping a device to the extensions 18.

Figure 7:
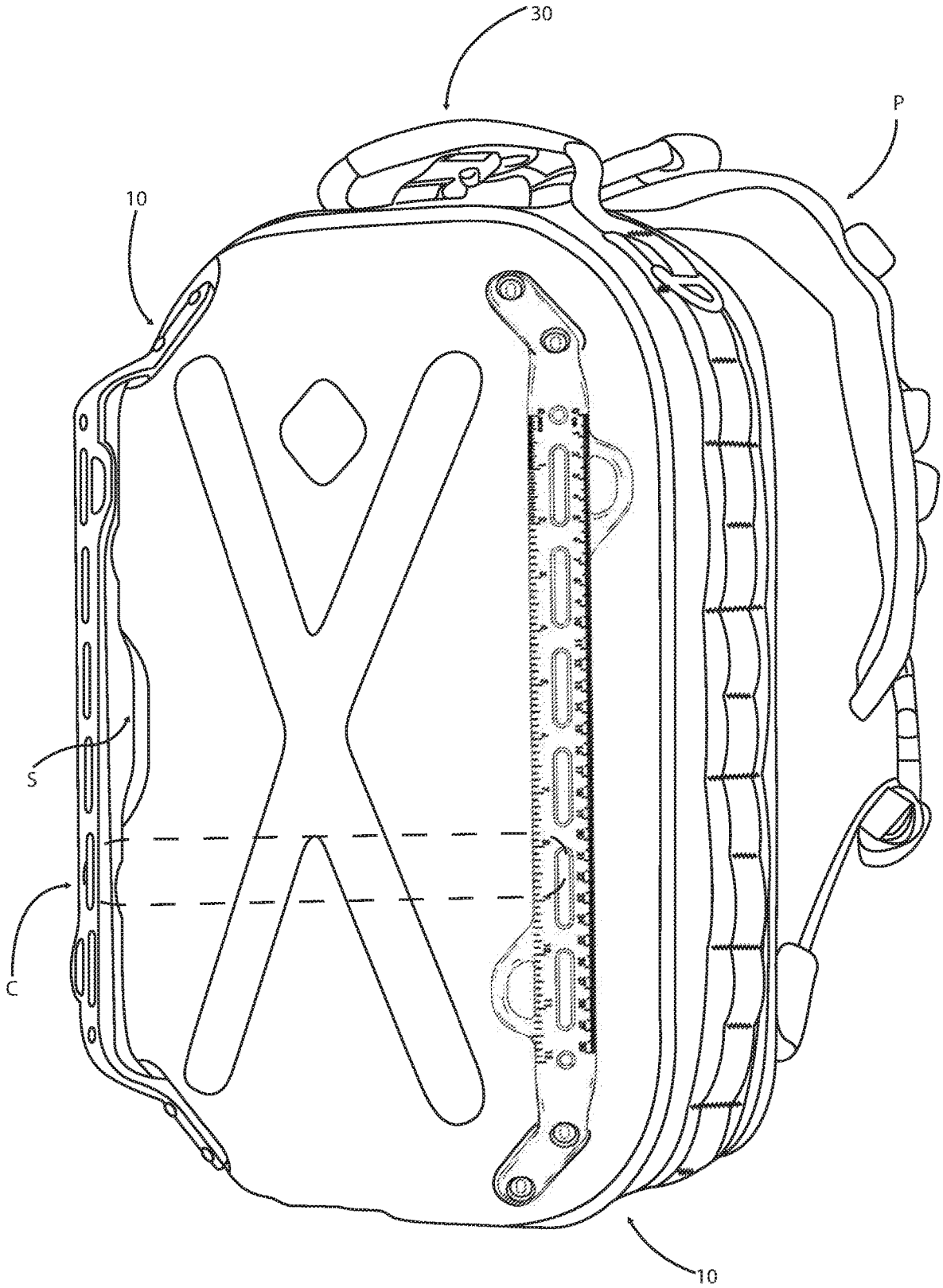
FIG. 7 illustrates a pair of load rails on an exemplary backpack.

From FIG. 7, it can be understood that a pair of rails 10 may be provided on one side of a single pack (backpack 30), such as the side opposite the straps P for being worn by a user. The rails 10 may be spaced apart on opposite ends of the same side of the backpack 30, as shown, but could also be more closely spaced together. Consequently, a connector C (such as a strap, webbing, elastic (bungee) cord, or the like) may extend between or be laced through the spaced rails 10, such as for securing gear (e.g, clothing, a tent, or other oversized structure) to the backpack 30 and thereby expanding its carrying capacity (in addition to that provided by any interior compartment present).

The load rail 10 is a dimensionally stable, generally rigid structure, and may be fabricated of metal, plastic, or combinations thereof. The load rail 10 may comprise multiple pieces or a single unitary piece of material with the apertures 12, openings 14 and elongated openings, or slots 16, formed therein. The mounting screws 20 and fasteners 40 are typically made of metal as well, but could be hardened plastic, and may be provided with the load rail 10 or as part of another device associated therewith (such as a knife sheath). By contrast, the backpack 30 is typically at least partially formed of a flexible structure formed of a fabric material, but as noted above may also comprise a rigid portion or panel 30*b* to which the load rail(s) are connected.

The load rail 10 may also optionally include a ruler R, as shown in FIG. 1. The ruler R may be provided along each side of the rail 10, and may be of different units (e.g., inches and centimeters) to facilitate taking a variety of measurements.

This disclosure may be considered to pertain to the following items:

1. An apparatus for securing items to a pack adapted for being carried by a user, comprising:

a load rail including a plurality of openings; and fasteners for removably securing the load rail to the pack.

2. The apparatus of item 1, wherein the plurality of openings include a plurality of central openings extending along load rail.

3. The apparatus of item 1, wherein the plurality of openings are located at opposed end portions of the load rail for receiving the fasteners.

4. The apparatus of item 1, wherein the rail includes at least one D-ring forming one of the plurality of openings.

5. The apparatus of item 1, wherein at least one of the plurality of openings comprises a slot.

6. The apparatus of item 1, the load rail comprises depending feet.

7. The apparatus of item 1, wherein end portions of the load rail extend at an angle relative to a longitudinal axis of the load rail.

8. The apparatus of item 1, wherein the load rail is generally C-shaped.

9. An apparatus adapted for being carried by a user, comprising:

a pack including a first side including a strap for being worn by the user and a second side including at least one load rail.

10. The apparatus of item 9, wherein the pack includes a plurality of load rails.

11. The apparatus of item 10, further including a connector extending between the plurality of load rails.

12. The apparatus of item 10, wherein the plurality of load rails are removably attached to the pack.

13. The apparatus of item 9, wherein the at least one load rail includes a plurality of openings for receiving fasteners for fastening to the pack.

14. The apparatus of item 9, wherein a central portion of the at least one load rail is elevated above and spaced from an adjacent surface of the pack.

15. An apparatus adapted for being carried by a user, comprising:

a pack including a first side associated with a strap for being worn by the user and a second side including at least one load rail having first and second end portions connected to the pack.

16. The apparatus of item 15, wherein the load rail comprises a plurality of openings, and further including fasteners for extending through each of the plurality of openings for fastening the at least one load rail to the pack.

17. The apparatus of item 16, wherein the pack comprises a rigid panel including a recessed portion having at least one hole for receiving at least one of the fasteners.

18. The apparatus of item 15, wherein the at least one load rail includes at least one D-ring.

19. The apparatus of item 15, wherein the pack further includes at least one strap adapted for being worn by the user.

20. The apparatus of item 15, wherein a portion of the at least one load rail intermediate the first and second end portions is elevated from an adjacent surface of the pack.

21. The apparatus of any of the foregoing items, wherein the load rail comprises a dimensionally stable material As used herein, the following terms have the following meanings:

"A", "an", and "the" as used herein refers to both singular and plural referents unless the context clearly dictates otherwise. By way of example, "a compartment" refers to one or more than one compartment.

"About," "substantially," "generally" or "approximately," as used herein referring to a measurable value, such as a parameter, an amount, a temporal duration, and the like, is meant to encompass variations of +/−20% or less, preferably +/−10% or less, more preferably +/−5% or less, even more preferably +/−1% or less, and still more preferably +/−0.1% or less of and from the specified value, in so far such variations are appropriate to perform in the disclosed invention. However, it is to be understood that the value to which the modifier "about" refers is itself also specifically disclosed.

"Comprise", "comprising", and "comprises" and "comprised of" as used herein are synonymous with "include", "including", "includes" or "contain", "containing", "contains" and are inclusive or open-ended terms that specifies the presence of what follows, e.g., "component includes" does not exclude or preclude the presence of additional, non-recited components, features, element, members, steps, known in the art or disclosed therein.

While preferred embodiments have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the protection under the applicable law and that methods and structures within the scope of these claims and their equivalents be covered thereby.

What is claimed:

1. An apparatus for securing one or more items to a pack adapted for being carried by a user, comprising:

a load rail including a plurality of openings, including at least one intermediate opening;

fasteners for removably securing the load rail to the pack; and a connector for positioning in the intermediate opening of the load rail to secure the one or more items thereto;

wherein the load rail comprises an intermediate portion bounded by ends comprising depending feet adapted to offset the intermediate portion from a surface of the pack when the load rail is secured thereto, the intermediate portion including the at least one intermediate opening.

2. The apparatus of claim 1, wherein the load rail includes at least one D-ring forming one of the plurality of openings, the D-ring formed by a loop projecting from one lateral side of the load rail.

3. The apparatus of claim 1, wherein the intermediate opening comprises a slot adapted to receive the connector and to allow for movement within the slot to adjust the mounting position of the one or more items.

4. The apparatus of claim 1, wherein end portions of the load rail for receiving the fasteners extend at an angle relative to a longitudinal axis of the load rail.

5. The apparatus of claim 1, wherein the load rail is generally C-shaped.

6. The apparatus of claim 1, wherein the connector comprises a threaded fastener.

7. The apparatus of claim 1, wherein a plurality of spaced load rails are provided, and the connector is laced through the spaced load rails.

8. An apparatus adapted for being carried by a user, comprising:

a pack including a first side having at least one strap for carrying the pack and a second side opposite the first side including at least one load rail, the load rail including a portion spaced from an adjacent surface of the pack so that a connector may be inserted in a space between the load rail and the surface to connect one or more items to the load rail;

wherein the pack includes a plurality of load rails on the second side;

wherein the plurality of load rails are removably attached to the pack and are not connected to each other.

9. The apparatus of claim 8, further including a connector extending across the second side of the pack between the plurality of load rails.

10. The apparatus of claim 8, wherein the at least one load rail includes a plurality of openings for receiving fasteners for fastening to the pack.

11. The apparatus of claim 8, wherein end portions of the at least one load rail contact a surface of the pack and an intermediate portion of the at least one load rail is elevated above the surface of the pack so as to form the space.

12. The apparatus of claim 8, wherein the second side of the pack adjacent the load rail is rigid.

13. An apparatus adapted for being carried by a user, comprising:

a pack including a first side associated with at least one strap for being worn by the user and a second side including at least one load rail having first and second end portions connected to the pack and an intermediate portion between the first and second end portions, the first and second end portions comprising depending feet adapted to offset the intermediate portion from an adjacent surface of the pack when the load rail is secured thereto.

14. The apparatus of claim 13, wherein the load rail comprises a plurality of openings, and further including fasteners for extending through each of the plurality of openings for fastening the at least one load rail to the pack.

15. The apparatus of claim 14, wherein the pack comprises a rigid panel including a recessed portion having at least one hole for receiving at least one of the fasteners.

16. The apparatus of claim 13, wherein the at least one load rail includes at least one D-ring, the D-ring formed by a loop projecting from one lateral side of the load rail.

17. The apparatus of claim 13, wherein the pack further includes at least one strap adapted for being worn by the user.

18. The apparatus of claim 13, wherein the intermediate portion of the at least one load rail is elevated above an adjacent surface of the pack and further including a connector in a space between the load rail and the adjacent surface to connect one or more items to the load rail.

19. The apparatus of claim 18, wherein the connector comprises a threaded fastener projecting through the at least one load rail in a direction opposite the pack.

20. The apparatus of claim 18, wherein the at least one load rail comprises a plurality of spaced load rails, and the connector is laced through the plurality of spaced load rails.

21. The apparatus of claim 13, wherein the second side of the pack adjacent the load rail is rigid.

* * * * *